US008844298B2

(12) United States Patent
Woidtke et al.

(10) Patent No.: US 8,844,298 B2
(45) Date of Patent: Sep. 30, 2014

(54) VIBRATION REDUCING SAMPLE MOUNT WITH THERMAL COUPLING

(75) Inventors: Alex Woidtke, Bozeman, MT (US); Peter B. Sellin, Bozemin, MT (US); Luke Mauritsen, Belgrade, MT (US); David Snow, Bozeman, MT (US)

(73) Assignee: S2 Corporation, Bozeman, MO (US)

( * ) Notice: Subject to any disclaimer, the term of this patent is extended or adjusted under 35 U.S.C. 154(b) by 1160 days.

(21) Appl. No.: 12/621,306

(22) Filed: Nov. 18, 2009

(65) Prior Publication Data

US 2010/0127148 A1 May 27, 2010

Related U.S. Application Data

(60) Provisional application No. 61/193,325, filed on Nov. 18, 2008.

(51) Int. Cl.

| | |
|---|---|
| ***F16M 13/00*** | (2006.01) |
| ***F16M 1/00*** | (2006.01) |
| ***F25B 19/00*** | (2006.01) |
| ***F25D 19/00*** | (2006.01) |

(52) U.S. Cl.
CPC ..... *F25D 19/006* (2013.01)
USPC ..... 62/51.1; 62/55.5; 248/636; 248/638

(58) Field of Classification Search
CPC ..... F25D 19/00; F25D 19/006; F25D 23/006; F25B 2500/13
USPC ..... 62/51.1, 297; 248/636, 638
See application file for complete search history.

(56) References Cited

U.S. PATENT DOCUMENTS

| | | | | |
|---|---|---|---|---|
| 3,721,101 | A | 3/1973 | Sheppard et al. | |
| 3,751,137 | A * | 8/1973 | Fitzgibbons et al. | 349/153 |
| 3,894,403 | A | 7/1975 | Longsworth | |
| 4,161,747 | A * | 7/1979 | Frosh et al. | 257/716 |
| 4,242,611 | A * | 12/1980 | Douglass | 310/344 |
| 4,394,819 | A | 7/1983 | Averill | |
| 4,438,632 | A | 3/1984 | Lessard et al. | |
| 4,644,761 | A * | 2/1987 | Chatzipetros et al. | 62/51.1 |
| 4,763,483 | A | 8/1988 | Olsen | |
| 4,854,131 | A | 8/1989 | Sakitani et al. | |
| 4,869,068 | A | 9/1989 | Van Vloten | |
| 5,077,637 | A | 12/1991 | Martorana et al. | |
| 5,129,232 | A | 7/1992 | Minas et al. | |
| 5,180,903 | A * | 1/1993 | Shigeno et al. | 235/449 |
| 5,317,879 | A | 6/1994 | Goldberg et al. | |
| 5,327,733 | A | 7/1994 | Boolchand et al. | |
| 5,782,096 | A | 7/1998 | Bartlett et al. | |
| 6,516,281 | B1 | 2/2003 | Wellstood et al. | |

(Continued)

OTHER PUBLICATIONS

Notice of Allowance mailed Jul. 10, 2012 issued in related U.S. Appl. No. 12/749,036.

*Primary Examiner* — Frantz Jules
*Assistant Examiner* — Keith Raymond
(74) *Attorney, Agent, or Firm* — Miles & Stockbridge P.C.; Michael A. Messina

(57) ABSTRACT

A sample mounting apparatus for a cryo-cooler is provided having a housing with an outer wall surface for connecting to the cryo-cooler, and an inner wall surface. An inert gas is sealed inside the housing for thermal transfer, and a delicate mount is attached to the inner wall surface of the housing for supporting the sample and substantially preventing vibrations from being transferred to the sample from the cryo-cooler.

15 Claims, 20 Drawing Sheets

(56) References Cited

U.S. PATENT DOCUMENTS

| | | | | |
|---|---|---|---|---|
| 7,074,364 | B2 | 7/2006 | Jahn et al. | |
| 2002/0042145 | A1 | 4/2002 | Forsberg | |
| 2004/0108067 | A1 | 6/2004 | Fischione et al. | |
| 2005/0188705 | A1 | 9/2005 | Jones et al. | |
| 2005/0223716 | A1 | 10/2005 | Arav | |
| 2006/0147248 | A1 | 7/2006 | Fukui et al. | |
| 2007/0098699 | A1 | 5/2007 | Rudd | |
| 2007/0231872 | A1 | 10/2007 | Butters et al. | |
| 2007/0261429 | A1* | 11/2007 | Teehan | 62/378 |
| 2008/0241404 | A1 | 10/2008 | Allaman et al. | |
| 2009/0293505 | A1* | 12/2009 | Wang | 62/51.1 |
| 2010/0050661 | A1 | 3/2010 | Snow et al. | |
| 2010/0127148 | A1 | 5/2010 | Woidtke et al. | |

* cited by examiner

SAMPLE IN VACUUM

CUBE SAMPLE

CYLINDRICAL SAMPLE

SAMPLE IN GAS OR LIQUID

CUBE SAMPLE

CYLINDRICAL SAMPLE

SAMPLE IN VACUUM

CUBE SAMPLE

CYLINDRICAL SAMPLE

SAMPLE IN GAS OR LIQUID

CUBE SAMPLE

CYLINDRICAL SAMPLE

VIBRATION REDUCING SAMPLE MOUNT WITH THERMAL COUPLING

CROSS REFERENCE TO PROVISIONAL APPLICATION

This application is based upon and claims the benefit of priority from Provisional U.S. Patent Application 61/193,325 filed on Nov. 18, 2008, the entire contents of which are incorporated by reference herein.

GOVERNMENT INTEREST

This invention was made with government support under Grant No. DASG60-03-C-0075, awarded by the US ARMY SPACE & MISSILE DEFENSE COMMAND. The Government has certain rights in the invention.

BACKGROUND

1. Field of the Disclosure

This disclosure relates to low temperature cooling devices. Particularly, this disclosure relates to a gas exchange housing for low stress and strain mounting of a sample while reducing vibrations transferred to, and providing optical access to, the sample.

2. Description of the Related Art

Cryogen-free refrigerators, also called cryo-coolers or cryostats, utilize a closed-cycle circulating refrigerant (often helium gas) to extract heat from a cold finger at cryogenic temperatures and pump it away to a heat exchanger. The cold finger is a metallic heat sink which is actively cooled by the refrigerant. The cold finger can be temperature controlled and serves as a mounting point for an object. The main goal of attaching the object to the cold finger is that the object will be cooled. Objects to be cooled can include semiconductor devices, detectors, mechanisms, material samples, or any other objects that require fixed, cryogenic temperature operation.

While direct contact coupling of the object can cool the object (i.e., cooling is where heat is transferred from the object to the cold finger), in some applications, direct contact alone does not provide adequate performance, because the mechanical operation of the cryo-cooler couples energy in the form of vibrations, acoustic noise, or other into the object via the thermal contacts of the object. In these applications, it is necessary to delicately mount the object such that it is cooled but isolated, or not disturbed, by cryo-cooling the apparatus.

FIGS. 18A-D are diagrams of the mounting of a sample in a open cycle cryostat. For explanation of the elements, see FIG. 17. Open cycle cryo-coolers are those where the coolant is liquid helium. Bonds such as indium, clamping, or grease are used for bonding a sample to the cold finger when in a vacuum. When in a gas or liquid atmosphere, the sample is held in place simply with a piece of tape or small spring.

In testing sensitive objects as mounted in open cycle cryostats, during sensitive experiments, problems are typically not observed. As is shown in FIGS. 18A-D, no negative effects on the mounted and cooled object arise due to coupling of energy from the mounting apparatus (such as that from the cold finger) during the experiment, since the mounted object is not experiencing any significant external disturbances from the transfer of liquid helium to the cold finger. Good performance in experiments is generally observed, independent of the function of the experiment, when the matter involved with the cooling has good thermal transfer, is stationary and not under any stress.

When moving from an open cycle system to a closed cycle system, one major change is seen. In an open cycle system, there is no force on the representative cold finger. However, in a closed cycle system a mechanical noise/force is present. If one uses mounts created for an open cycle cryostat the forces are coupled directly into the sample as shown in FIGS. 19A-D. Closed-cycle cryo-coolers or cryo-refrigerators are mechanical devices which provide cooling to a cold finger via pressure cycling of gas.

In a conventional closed-cycle cryo-cooler, the sample is mounted to a cold finger in a vacuum, where good thermal contact is required. The thermal contact is ideally provided by a physical mount with substantial contact area and large thermal conduction with the sample. Good thermal contact is usually achieved with firm pressure and intermediary grease or other filling-material. Indium can be used to attach the object and the metal cold finger. However, a stiff contact from firm pressure can too easily couple vibrations or induce undesired stresses in sensitive materials.

The main problem in a closed-cycle cryo-cooler is that mechanical work is required to produce cooling power rather than obtaining cooling from a liquid source. This mechanical power produces the expansion of compressed gas at the cold finger, and thus typically transfers vibrations to the sample mount. This repeated rhythmic hammering, although at low frequency usually 1-2 Hz, drives higher frequency resonances inside the cryostat. High frequency, high intensity vibrations can also be created from the gas flow through the head across sharp corners or other imperfections in the piping, thereby creating noise that will interfere with a sensitive experiment. High intensity, high frequency vibrations couple into a sample through the physical contact of a mount. These high frequency vibrations produce a very unstable mounting platform for sample mounts. The best conventional sample holders in closed cycle cryostats coupled the least amount of vibrations into a crystalline sample, but still had inadequate performance.

SUMMARY

To overcome the above mentioned problems, this disclosure identifies a sample mounting apparatus for a cryo-cooler comprising a housing having an outer wall surface for connecting to the cryo-cooler, and an inner wall surface; wherein the housing is sealable to contain an inert gas for thermal heat transfer; and a delicate mount attached to the inner wall surface of the housing for supporting the sample and substantially preventing vibrations from being transferred to the sample from the cryo-cooler.

Also disclosed is a method of reducing vibrations in a sample for use in a cryo-cooler comprising the steps of: a) mounting a sample in a sample mounting apparatus, wherein the sample mounting apparatus comprises a housing having an outer wall surface for connecting to a cryo-cooler, and an inner wall surface, and a delicate mount attached to the inner wall surface of the housing for supporting the sample and substantially preventing vibrations from being transferred to the sample from the cryo-cooler, b) sealing the walls of the housing by applying a sealant such that the walls do not allow gas to enter or leave the housing, c) evacuating the housing of gas via a gas inlet tube, d) adding an inert gas via the gas inlet tube, e) sealing the housing by closing the gas inlet tube, and f) attaching the outer wall of the housing to a cryo-cooler.

A block diagram representing the proposed solution is shown in FIGS. 20A-B. The forces that are coupled into the sample can disturb sensitive experiments, and instead the housing, or gas-exchange box (GXB) is used which provides cooling while de-coupling the forces from the mounted sample. This diagram shows two embodiments of the GXB, one with a cylindrical sample and one with a cube sample, where both samples are supported from a shaft. A key component to achieving this decoupling is the use of mounts such as bearings (ball bearings, jewel bearings, etc) to attach a support mechanism (shaft, etc) to the walls of the GXB.

Additional advantages and other features of the present disclosure will be set forth in part in the description which follows and in part will become apparent to those having ordinary skill in the art upon examination of the following or may be learned from the practice of the disclosure. The advantages of the disclosure may be realized and obtained as particularly pointed out in the appended claims.

As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

DETAILED DESCRIPTION OF ILLUSTRATIVE EMBODIMENTS

Advantageous aspects of the described mounting system are good thermal contact through convection and conduction, de-coupling of external vibrations from the sample, preventing cracking of delicate samples from uncompensated thermal contraction, and avoiding temporary or permanent distortions of the sample from applied strains.

Figure 1:
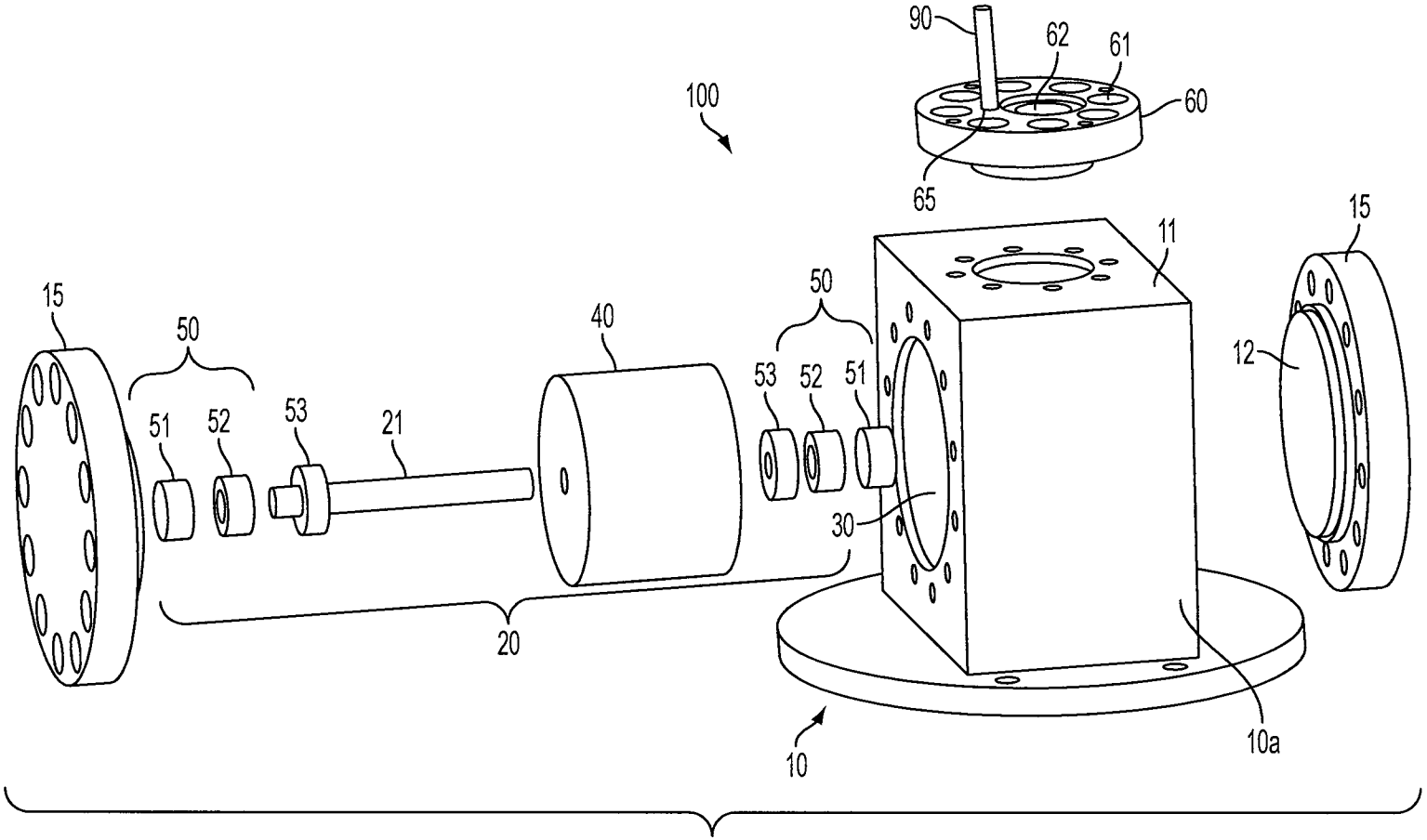
FIG. 1 is an expanded view of a sample mounting apparatus according to one embodiment of the present disclosure.

As shown in FIG. 1, the present disclosure is directed toward a sample mounting apparatus 100 for a conventional cryo-cooler (not shown) comprising a housing 10 having an outer wall surface 11 for connecting to the cryo-cooler, and an inner wall surface 12, an inert gas (not shown) sealed inside the housing 10 for heat transfer, and a delicate mount 20 attached to the inner wall surface 12 of the housing 10 for supporting a sample 40 and substantially preventing vibrations from being transferred to the sample 40 from the cryo-cooler.

The housing 10 comprises a main body 10*a* and a removable end plate 15, and the endplate 15 is sealed to the main body 10*a* with a sealant that can create an air-tight seal. Examples of sealants are indium, epoxy, and solder. The inert gas 30 sealed inside the housing 10 may be any inert gas suitable for heat transfer in low temperature applications. In certain embodiments, the inert gas is helium. Alternatively, nitrogen is used.

As also shown in FIG. 1, the delicate mount 20 comprises a shaft 21 attachable to the sample 40, and a vibration reducing connector for movably connecting the shaft 21 to the housing inner wall surface 12. In certain embodiments, the vibration reducing connector comprises a conventional ball bearing assembly 50 for rotatably mounting the shaft 21 to the housing inner wall surface 12. The vibration reducing connector optionally further comprises a sleeve 51 attached to the housing inner wall surface 12 and a ball bearing assembly 50 attached to the sleeve 51 and the shaft 21 for rotatably mounting the shaft 21 to the housing inner wall surface 12.

Figure 11:
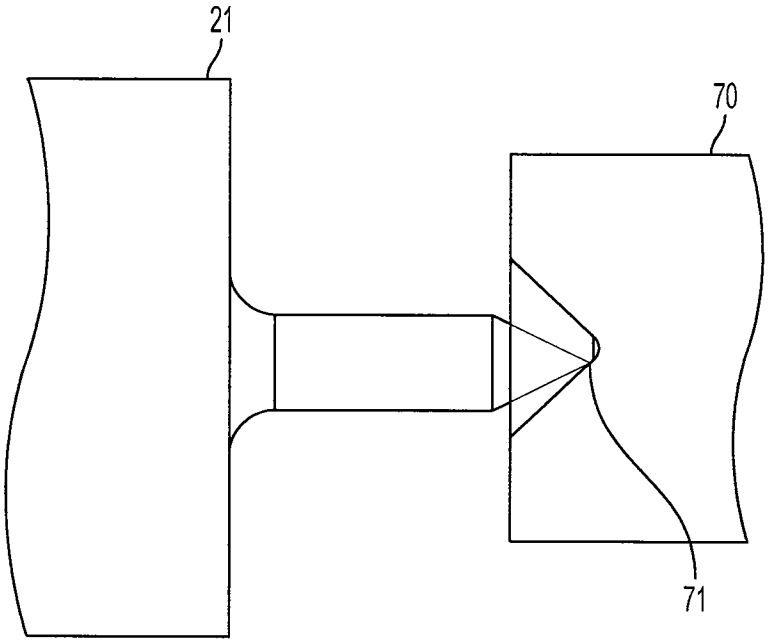
FIG. 11 is a side view of a shaft having a point contact with a Vee Jewel bearing according to another embodiment of the present disclosure.

Alternatively, as shown in FIG. 11, the vibration reducing connector comprises a conventional jewel bearing 70 for rotatably mounting the shaft 21 to the inner wall surface 12. Alternatively, the delicate mount 20 comprises a hammock support for the sample. The hammock can use a spring attachment for connecting to the inner surface of the housing 12.

Figure 14:
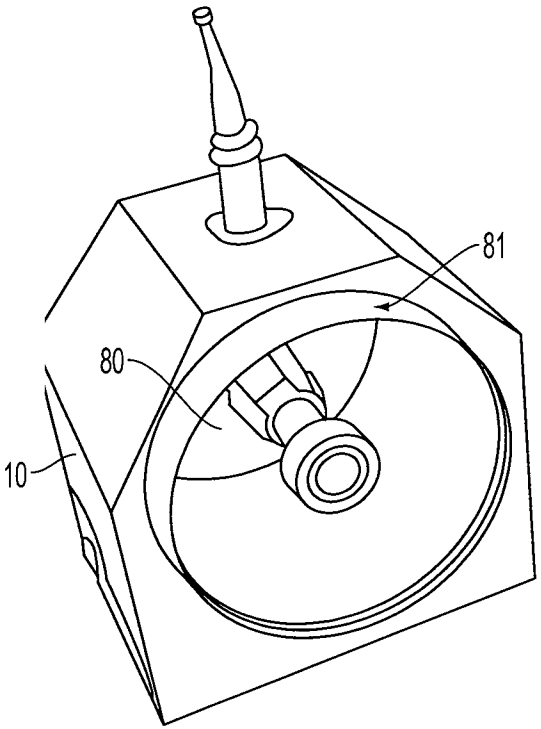
FIG. 14 is a top perspective view of a housing sealed with epoxy according to another embodiment of the present disclosure.

In another embodiment of the present disclosure, such as shown in FIG. 14, the housing 10 further comprises a transparent window portion 80 for optical access to the sample. The window portion 80 can be sealed to the housing 10 with any known sealant suitable for low temperature operations. In some embodiments, an indium seal, epoxy seal or glue is used for sealing the window portion 80. To prevent damage to the window 10, the housing 10 contains a housekeeper seal 81 to accommodate the differences in size of materials due to thermal expansion. In other embodiments, the sleeve 51 and bearing assembly 50 are attached to the housing inner wall 12 via epoxy, solder or mechanical attachments. Any suitable material for cold temperature applications may be used for the housing 10. One example of a suitable material is copper.

Figure 2:
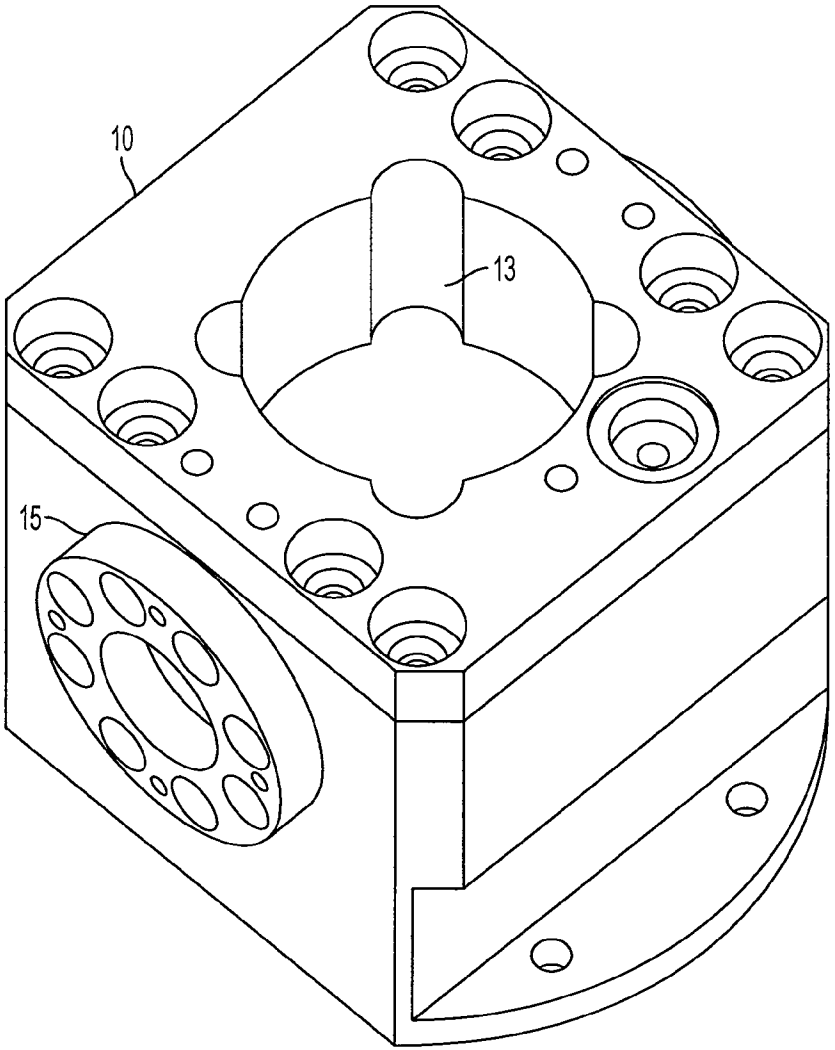
FIG. 2 is a top view of a housing with recesses in the external housing for magnets according to another embodiment of the present disclosure.

Further, the housing optionally further comprises recesses in the external housing for inserting at least one magnet such that a variable homogeneous or inhomogeneous magnetic field is applied to the sample. For example, as shown in FIG. 2, the housing 10 comprises a series of recesses 13 into which magnets (not shown) may be inserted.

A method of using the sample mounting apparatus for reducing vibrations in a sample for use in a cryo-cooler comprises the steps of mounting a sample in a sample mounting apparatus, such as the sample mounting apparatus described above in FIG. 1. Then, the endplates 15 of the housing are sealed by applying a sealant such that gas does not enter or leave the housing 10. The housing 10 is then evacuated of gas, e.g., via a gas inlet tube 90, then an inert gas is added for heat transfer via the gas inlet tube 90. The housing 10 is then sealed by closing the gas inlet tube 90. Then, the outer wall 11 of the housing is attached to a cryo-cooler in order to cool the housing.

Further details of particular embodiments of the present disclosure are discussed below.

Figure 4B:
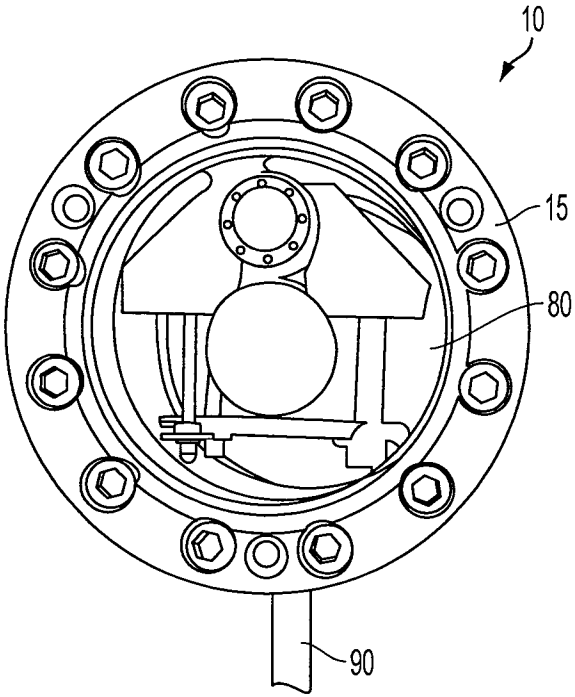
FIGS. 4A-B are views of a sample mounting apparatus according to another embodiment of the present disclosure.
Figure 4A:
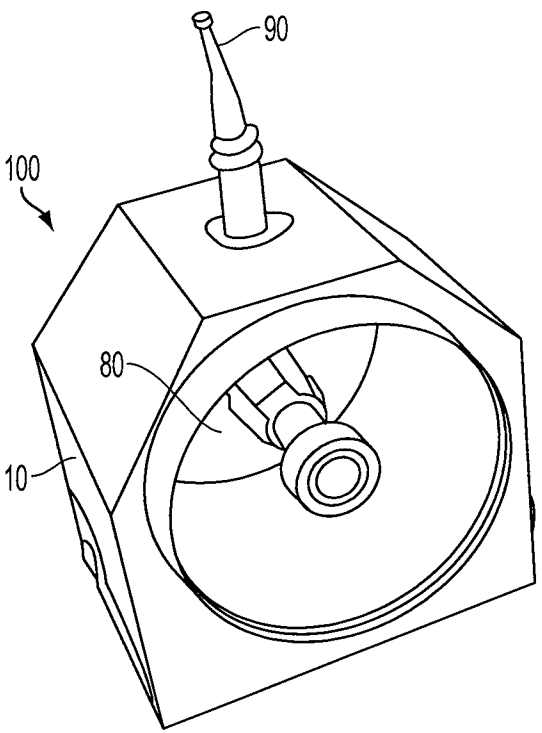

In one embodiment of the present disclosure, a sample mounting apparatus 100, also called a gas exchange box (GXB), is described. As shown in FIG. 1, a cold helium GXB 100 encases a sample 40 in gaseous helium while also delicately mounting the sample 40 in the GXB that encases the helium, so as to significantly dampen the coupling of external vibrations to the sample 40. In one embodiment of the present disclosure, the delicate mount 20 is a shaft and ball bearings. The shaft 21 is attached to the GXB inner wall 12 at two locations, each location has a sleeve 51 to hold a conventional ball bearing 52, and the shaft 21 is attached to the sample 40, which is positionally referenced by press-fitted collars 53 on either side. Other embodiments of delicate mount use conventional jewel bearings or some form of point contact that does not hold the sample support tightly. The GXB optionally includes optical access ports such as windows 80 shown in FIGS. 4A and 4B to allow light to irradiate the sample 40. Also provided is a method to fill the GXB 100 with helium gas and then seal the GXB 100.

Figure 3:
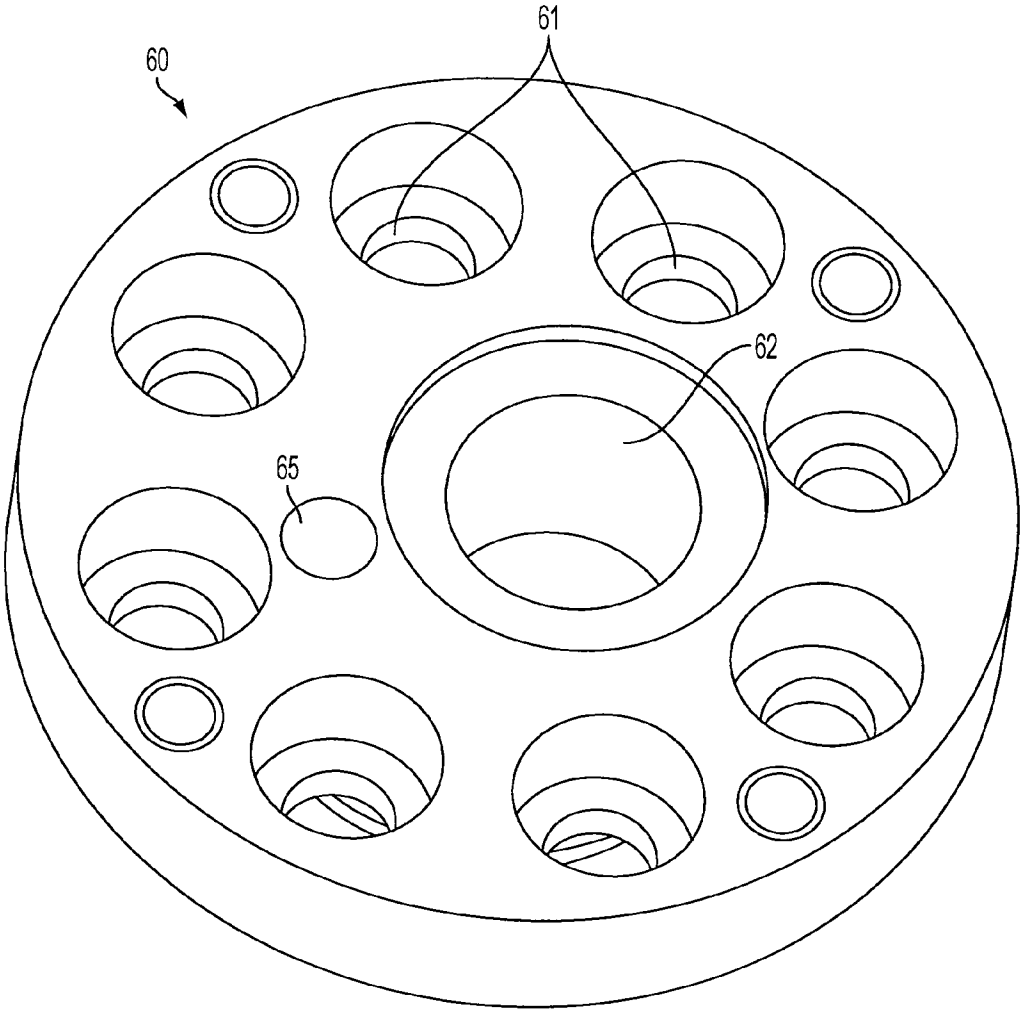
FIG. 3 is a view of a flange for sealing the housing according to another embodiment of the present disclosure.

According to one embodiment of the present disclosure as shown in FIGS. 1 and 3, the GXB 100 comprises a sealed housing 10 with an exchange gas 30, such as helium trapped inside. The gas 30 in the GXB 100 allows cooling of the sample 40. The GXB 100 has a flange 60 for sealing, with a purging port 61, a safety blow off valve 62 in case of overpressurization, a fill/drain tube 90 from which to perform the final fill and sealing of the box via the fill/drain port 65, a basis for mounting the sample 40, and windows 80 for optical access.

Sealing the GXB 100 can be accomplished by methods including solder, indium, and epoxy. They each have their advantages and drawbacks. For example, solder can be hard to apply to large perimeter seals due to the elevated working temperature. Indium can be difficult to work with due to continuity requirements needed for an effective pressed indium seal. Epoxy should only be used in very thin layers, otherwise shear driven cracking or fatigue of the base material may occur due to differential thermal expansion or contraction. In certain embodiments, the GXB uses a mix of all three sealing options in different locations.

In other embodiments of the present disclosure, copper is used as a base material for the housing 10. Advantages of using copper include that copper is readily solderable, has high thermal conductivity, and is fairly readily machineable.

The GXB 100 is alternatively made of other materials such as aluminum, steel, brass, plastic, molded epoxy, or composite materials having sufficient thermal conductivity.

Figure 5A:
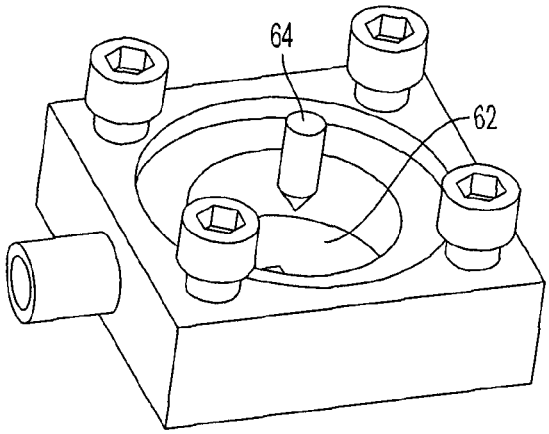
FIGS. 5A-C are views of a burst disk assembly according to another embodiment of the present disclosure.
Figure 5B:
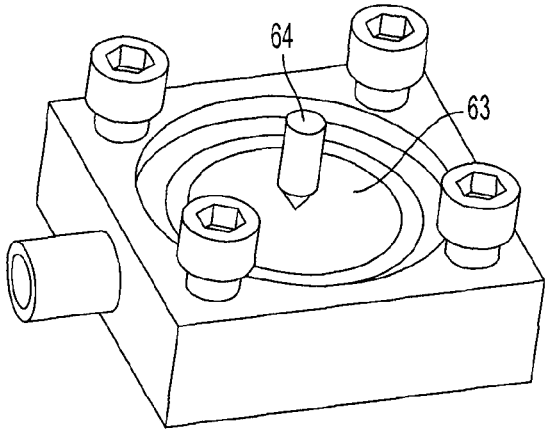
Figure 5C:
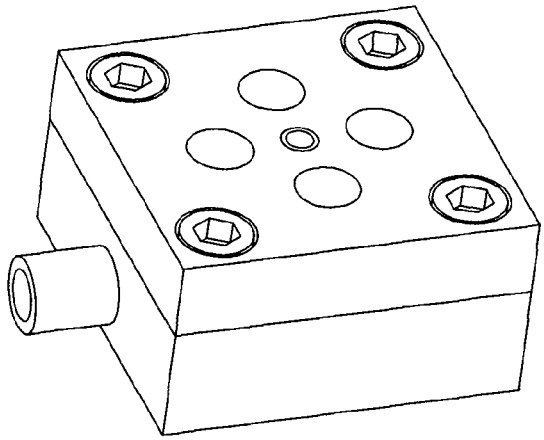

The filling and sealing of the system occur in the housing. As shown in FIGS. 1 and 3, blow-off valve 62 is designed into a flange 60 that is fastened to the housing 10 to allow for the system to safely release pressure in the event of over pressurization. The design makes a very compact slow release valve. One embodiment of a simple release mechanism comprises a piece of copper foil 63, shown in FIGS. 5A-C soldered over a small hole 62 in the flange 60. This design can be either remotely located or incorporated directly into the housing 10. After the copper foil 63 is soldered into place the top is bolted on which contains the release pin 64. Upon pressurization, the foil 63 bulges and punctures itself on the pin 64. One advantage to this system is that it can be reused many times by soldering a new piece of foil in place. There is some control over what pressure this valve will release; options for adjustment include: varying the diameter of the hole below the copper foil 63 and hence bulge height, sharpness of the pin 64, and pin to copper foil spacing.

Conventional housings have been sealed using a single fill/drain tube 90 soldered in place into the fill and drain port 65, which allows an access point that can be used to fill the GXB 100 with helium, then vacuumed out, and repeated until the purity of the atmosphere inside the GXB 100 is at a suitable level. In this manner, the purity of helium inside the GXB 100 increases in a geometric progression of rarefaction on each evacuation, multiplied by a reasonable number of repetitions. Using a copper fill/drain tube 90, such as that shown in FIGS. 4A-B, allows for sealing the box with a pair of dulled wire cutters, completely crimping the fill/drain tube 90 shut so that it is sealed before cutting the tube. If space permits, it is advantageous to crush one section of tube 90 then move down and crush another section in order to have a backup seal. A crimped tube is used because most valves will not work or are not reliable at 4 K, and extra space is required for a valve. Tubes can be made of many materials including aluminum, copper, copper-nickel, and brass. Copper is chosen for most designs because of its ability to solder directly to the housing, its ability to readily seal upon being crimped with dulled cutters, and the ability to place a backup solder seal at the tube end after crimping and cutting.

Alternatively, another style of fill/drain tube can be used. Before adding the components that cannot be heated, an intermediate section of brass tubing is soldered to the housing. Then a copper fill/drain tube is attached and soldered to the brass section. The low thermal conductivity of the brass will allow for a solder joint to be created at the interface between the brass tube and copper fill/drain line without coupling excessive heat. This allows for crimping of a copper based tube. Another option is the use of a copper-nickel tube which has low thermal conductivity and material properties similar to that of copper.

Another aspect of the GXB 100 for use in cryogenic temperatures below 4 K is the use of helium as an exchange gas which allows for a good thermal cryogenic contact without significant vibrational coupling. The use of an exchange gas like helium for wide area thermal equilibration also allows for a very stable sample temperature. The main requirements are that the gas not leak from the GXB 100. If a leak occurs, the vacuum that is insulating the cryo-cooler may be compromised, resulting in potential warm up of the whole system, and loss of cooling at the sample.

Thermal oscillations of a cold finger without any helium gas can be approximately 300 mK with a frequency of about 1-2 Hz depending on the type of cryo-cooler. These oscillations can interfere with sensitive measurements or experiments. Through the use of GXB 100, these oscillations have been shown to be reduced to 1 mK levels.

When using a GXB 100, thermal drift is observed in the system due to changing environmental conditions or other unseen changes. This thermal drift is best described as oscillations in milli-Kelvin on a time scale of 10 minutes to several hours.

Another aspect of the GXB design is isolation of the sample from external closed-cycle cryocooler vibrations by using a GXB 100 that houses a carefully mounted sample 40 convectively cooled by an exchange gas 30. The mounts can be designed and altered for alternative samples that vary in sizes and constraints.

Figure 6A:
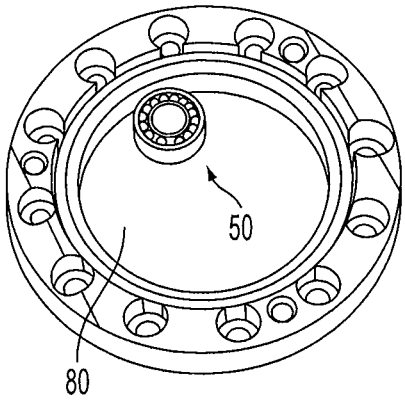
FIGS. 6A-B show a sleeve attached to a window of a housing according to another embodiment of the present disclosure.
Figure 6B:
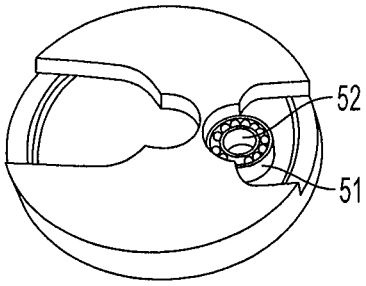

As shown in FIG. 1 a sample 40 is attached to a shaft 21, which is then loosely supported inside the GXB 100 with a bearing assembly 52. The bearing assembly 52 is supported by a thin copper sleeve 51 that is mounted to the inner surface 12 of the GXB 100 with an appropriate bonding method. In FIGS. 6A-B, a sleeve 51 is shown mounted to a window 80 surface with epoxy. In this embodiment, the sleeve 51 is mounted directly to the window surface 80. Other embodiments, such as that shown in FIGS. 7A-B, feature mounting the sleeve (not shown) to a metalized surface on the window 82 inside the GXB 100. Optionally, a bearing 52 is slipped into the sleeve 51 for mounting. The bearing 52 is typically a standard precision stainless steel ball bearing. However, many different types of bearings known in the art can be used. The size should be chosen based on parameters of the particular GXB. The bearings should be clean with no lubricants, but not so clean as to promote cold-welding. Otherwise when cooled, the lubricants will bind the system creating a rigid path for vibrations to travel into the mount.

When using epoxy, all bonding surfaces should cleaned thoroughly. The mating metal surface should be etched using some form of etching bath (such as sodium persulfate). All mating surfaces should be cleaned with an acetone wipe followed by a methanol wipe. This is to ensure no residual oils are left on the surface, and the combination of a clean etched surface will increase the strength of the epoxy bond, especially for use in challenging cryogenic environments.

Figure 8:
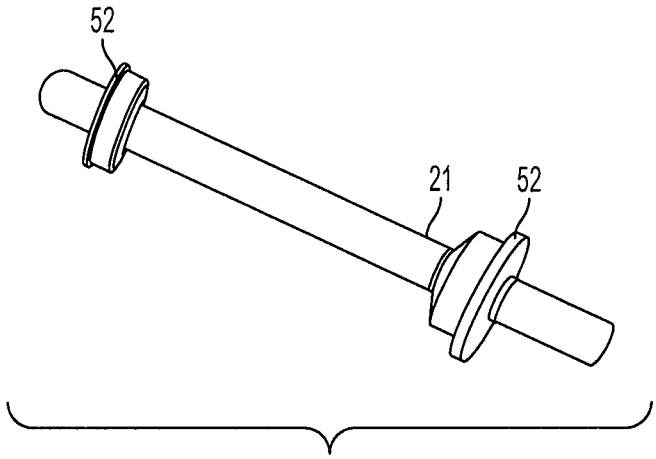
FIG. 8 shows a shaft for use in a delicate mount according to another embodiment of the present disclosure.
Figure 9A:
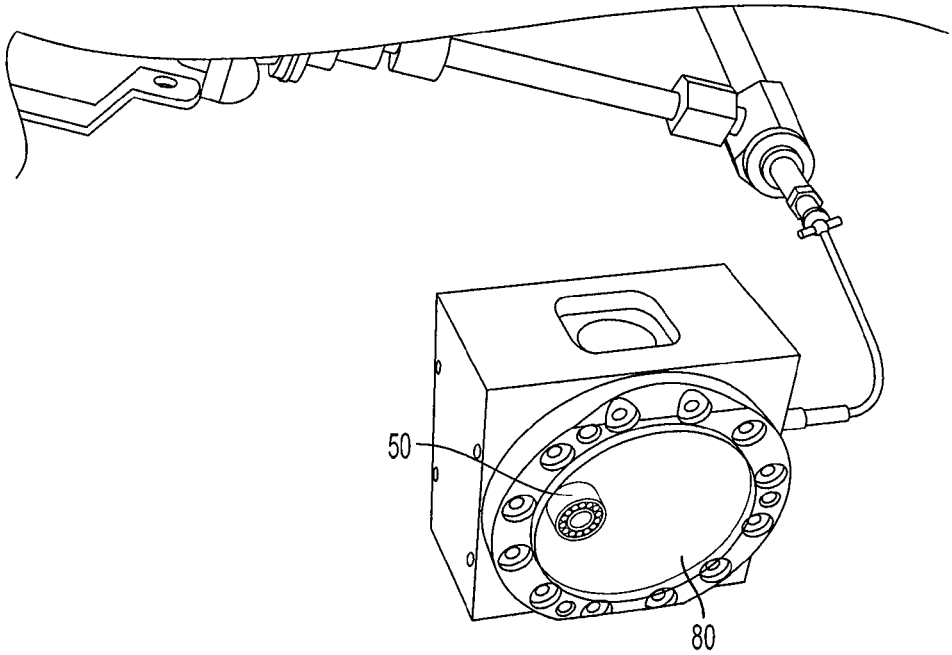
FIGS. 9A-B shows a sample mount apparatus having windows according to another embodiment of the present disclosure.
Figure 9B:
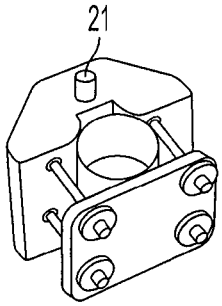

When assembling the GXB 100, a shaft 21, (such as shown in FIG. 8) is slipped into the inner race of the bearing 52 for support on one side. There has to be a second identical mount 52 on the opposite face of the GXB to allow the shaft 21 to be supported in such a way that it will rotate freely, and be able to slide axially inside the bearing races. If the shaft 21 is not allowed to slide axially, it could bind and break the windows 80 when the GXB 100 is cooled. In a windowless GXB, a shaft 21 that is not allowed to slide can create stress on the housing 10 which could break seals or compromise the structural integrity of the GXB 100. Generally, a shaft needs at least 0.005 in of axial shaft play for every inch of length to prevent stress. FIG. 9A shows window 80 with mounted bearing assembly 50. FIG. 9B shows a sample with a shaft 21 in a preassembly stage.

Figure 10:
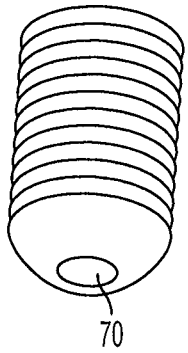
FIG. 10 is a view of a Vee Jewel bearing for use in another embodiment of the present disclosure.

In other embodiments, a sample is supported with a point contact with the solid housing, such as a pointed jewel bearing. The bearings act as the point contact with the housing. This mounting style provides very little stress placed on the sample, and high frequency vibrations are dampened due to the movable jewel bearing interface. This type of bearing uses a pointed shaft usually made of stainless steel that contacts a cut in a conventional sapphire jewel called a Vee jewel. An example is shown in FIG. 10, with a tiny Vee Jewel bearing 70 embedded in the tip of a small #2-80 set screw.

FIG. 11 depicts the functional operation of a Vee Jewel bearing 70. As is shown, this configuration allows for only point contact 71 between two very hard surfaces. The two hard surfaces provide very small frictional forces and allow the shaft 21 to "float" in place much as done in a bearing setup.

All of the above mounting styles result in an amount of movement while at the same time supporting the sample. This movement is what allows some vibrational isolation from the cold finger. If the sample 40 is physically hard mounted to the cold finger, it would not be isolated. The easily implemented shaft 21 in the above examples could be replaced with some form of support like a sling setup, hammock or other apparatus that will support an object.

Figure 12:
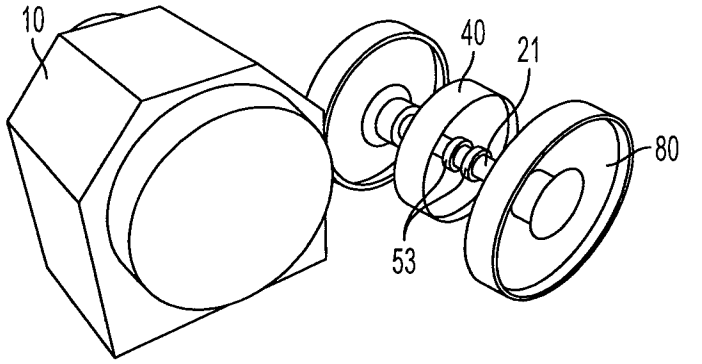
FIG. 12 is a view of a sample mounting apparatus showing the windows and sample connected via a shaft according to another embodiment of the present disclosure.

With the use of a GXB 100, a sample mount can be designed as if it were to be used in an open-cycle cryostat, which was a design for a sample mounted delicately in a helium environment. This mounting procedure allows for a very small force contact with the sample or just enough to keep the sample in position. FIG. 12 shows an example of a sample mount 100 which is held as gently as possible on a shaft 21. The shaft 21 is then supported by bearings 52 and races 51 (see FIG. 1) through only point contacts. In the sample mount in FIG. 12, the sample 40 such as optical crystal, has a hole for the shaft to pass through in the center, then it is gently held in place with the two collars 53 on the shaft 21, one behind and one in front, to create reference points for holding the sample 40 securely.

Figure 13:
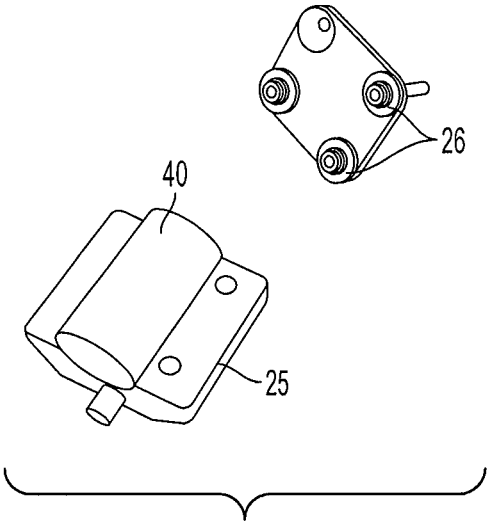
FIG. 13 is a view of a small cradle mount according to another embodiment of the present disclosure.

Another style of sample mounting on a shaft is shown in FIG. 13. This embodiment is for a sample that is not large enough to allow for a shaft to pass through the center, or where it is desirable to have optical access to more of the sample, among other variations. The sample 40 is gently clamped to an aluminum cradle 25 with springy Bellville washers 26 to allow for light clamping force—just enough force to hold the sample 40 in place. Other methods known in the art to gently attach the sample to the shaft may be used.

Mounting of a window onto a GXB allows for optical access to a cooled sample or device without birefringence created by strain from differing coefficient of thermal expansion (CTE). Various methods have been developed to allow for optical access, including seals made from epoxy, solder, or indium.

According to one embodiment, window mounting is performed with a thin mounting flange 81 that is machined into the window seat to relieve stresses induced from the housing. This rim is machined in to create a ledge for a window is sit in, thus reducing the stress and strain that occur on the window 80 while thermally cycling between about 300 K to about 4 K (see FIG. 14). This method of stress relieving is known as a housekeeper seal 81. If the metal is thick around the mounted window it will shrink down when cooled and crush the window 80. Windows smaller than 0.5 in can be mounted directly into the housing 10 often without undesired stress, but for larger diameter windows a housekeeper seal 81 is advised.

Figure 7A:
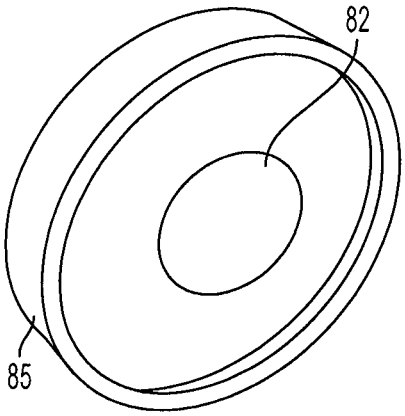
FIGS. 7A-B show a metalized window of a housing according to another embodiment of the present disclosure.
Figure 7B:
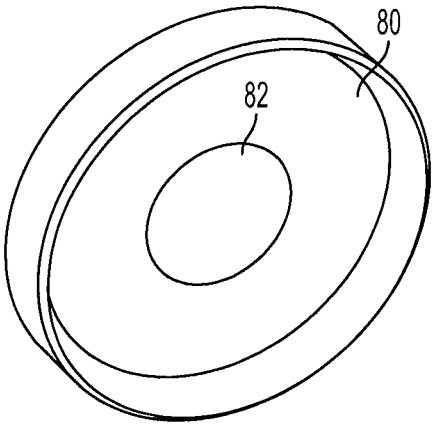

Windows that have been metalized at the sealing locations with deposited metal films, as shown in FIGS. 7A-B, can be soldered into place using a fluxless solder. This joint can be suitable for smaller diameter windows. Alternatively, a thin layer of epoxy 85 is used to seal windows. The epoxy layer 85 must be of sufficient thinness in order to allow for thermal contraction forces to be small enough such that the window material is not under stress. When cooled, epoxy 85 will shrink, causing stress on the window 80 and crack it.

When sealing a window 80 in place, care is taken to make sure the epoxy layer 85 is substantially even around the whole perimeter of the window 80. One method of accomplishing this is to epoxy the window 80 in place and twist the window 80 in the mount before the epoxy cures. This will allow the epoxy to flow into all crevices and fill any imperfections therefore creating an even layer.

When using epoxy, all components should be cleaned thoroughly. The mating metal surface should be etched using some form of etching bath (such as sodium persulfate). All mating surfaces should be cleaned with an acetone wipe followed by a methanol wipe. This is to ensure no residual oils are left on the surface, and the combination of a clean etched surface will increase the strength of the epoxy bond.

Figure 15:
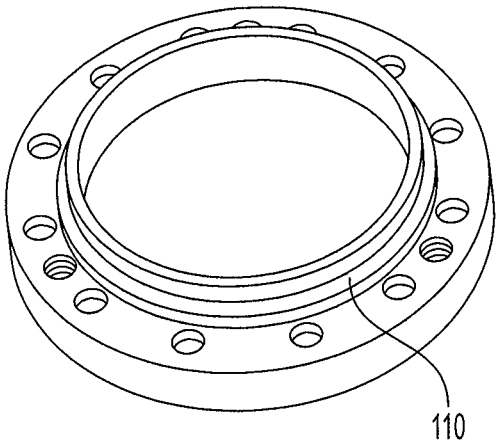
FIG. 15 shows a window blank housing according to another embodiment of the present disclosure.

An interchangeable window mount 110 as shown in FIG. 15 has also been developed for sealing the GXB. The resealable optical access mount 110 allows for cleaning a sample and cleaning of the GXB without having to rebuild the GXB. These interchangeable blanks allow for sealing of a window 80 to the mounting flange 110 using the methods described above, with the addition of an indium joint to seal the mounting flange 110 to the housing 10. An indium compression seal is used for the mount to the housing because it can be simply sealed and resealed without heating.

In certain embodiments, stiffer crystalline window materials such as sapphire or $Y_3Al_5O_{12}$ (YAG) are advantageous for several reasons. Fused silica windows are too fragile and prone to cracking over multiple thermal cycles, particularly in larger windows, and nominally non-birefringent BK7 glass windows became substantially birefringent under stress induced from compression forces from the mounts. Therefore, stiffer sapphire or YAG windows are used to overcome the birefringence effects and for their superior mechanical properties.

If applications where it is important that optical back reflections be minimized, the windows may be anti-reflection coated or wedged. Wedged windows reflect the optical beam in another direction, while anti-reflection coated windows allow the majority of the optical power to pass through with minimal reflected power.

The sample mount can, and in some cases is intended to, work with certain cryo-coolers, such as disclosed in U.S. Provisional Patent Application No. 61/136,138, filed Aug. 14, 2008, entitled "Apparatuses and Methods for Improving Vibration Isolation, Thermal Dampening, Optical Access in Cryogenic Refrigerators".

Figure 16:
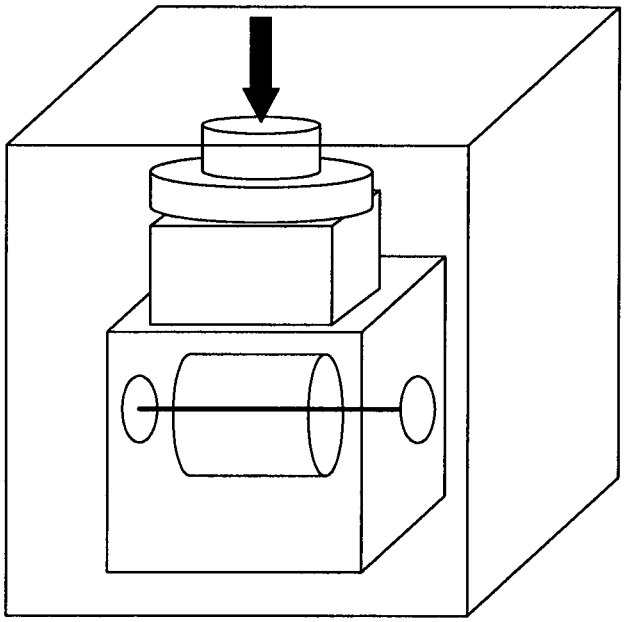
FIG. 16 is a representation of a cryostat according to another embodiment of the present disclosure in use with a cryo-cooler.
Figure 17:
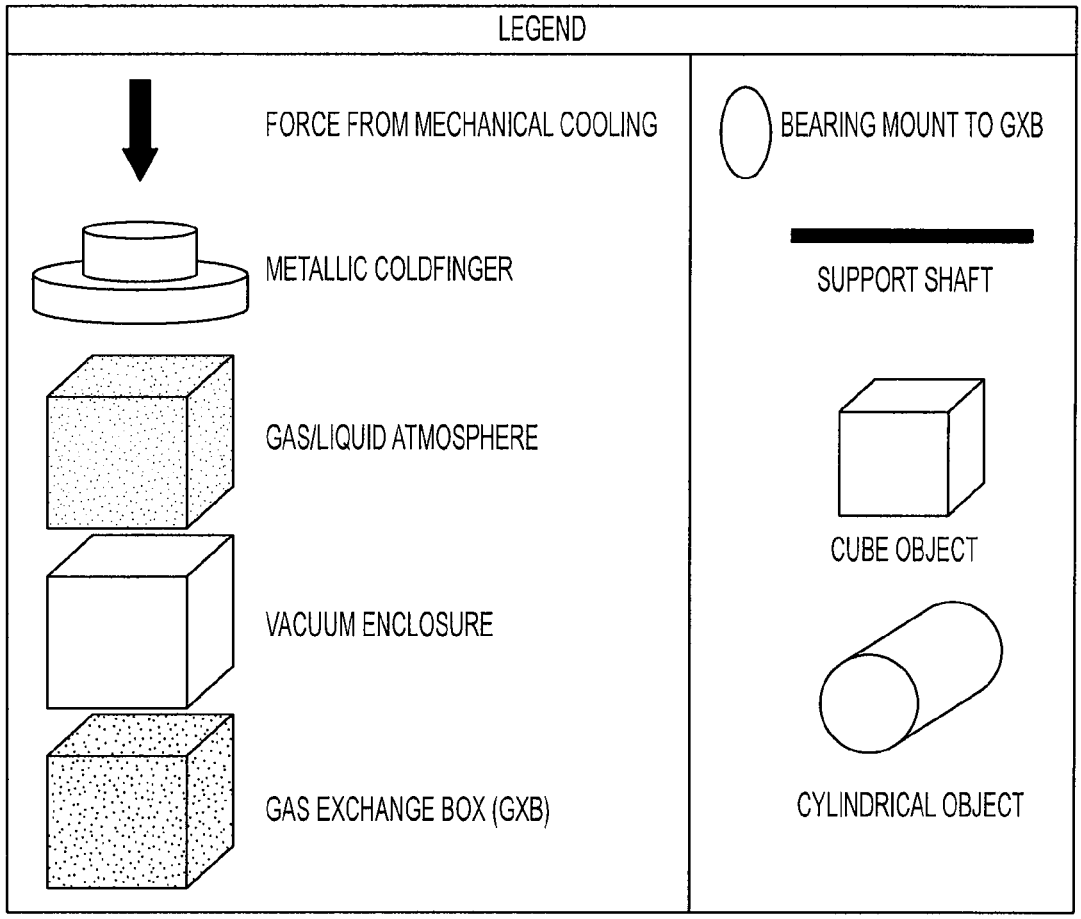
FIG. 17 is a legend for describing elements of cryocooling features.
Figure 18A:
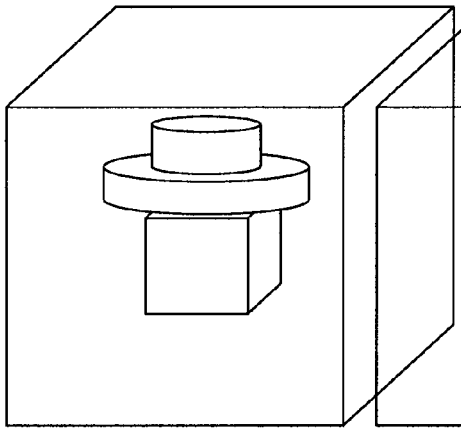
FIG. 18A PRIOR ART
FIGS. 18A-D shows open cycle cryostats.
Figure 18B:
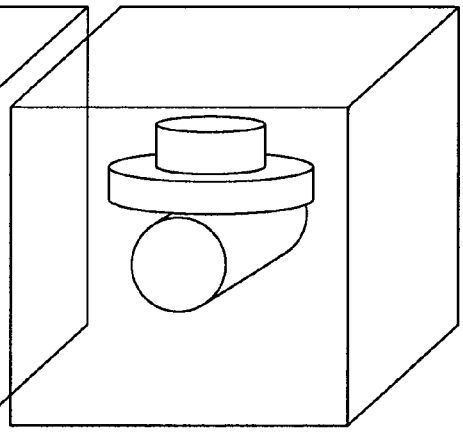
FIG. 18B PRIOR ART
Figure 18C:
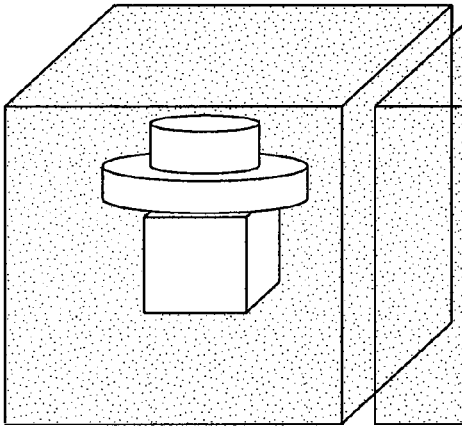
FIG. 18C PRIOR ART
Figure 18D:
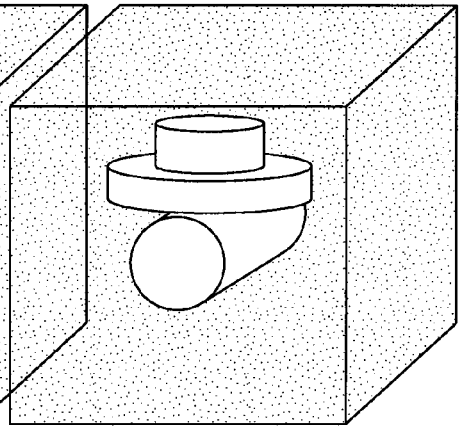
FIG. 18D PRIOR ART
Figure 19A:
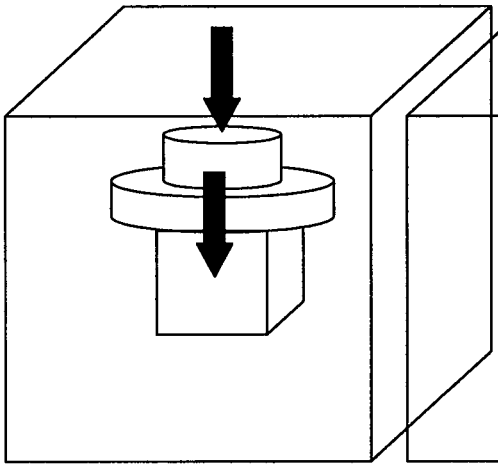
FIG. 19A PRIOR ART
FIGS. 19A-D shows closed cycle cryostats using open cycle mounting options.
Figure 19B:
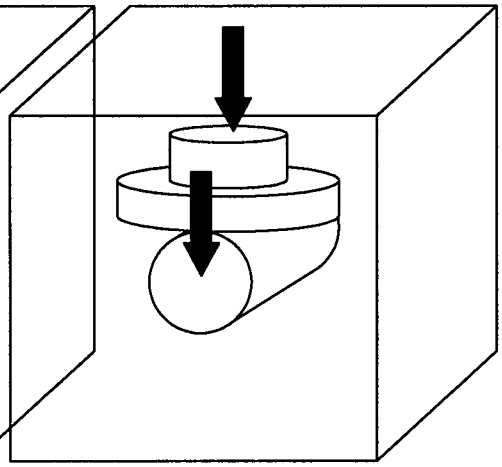
FIG. 19B PRIOR ART
Figure 19C:
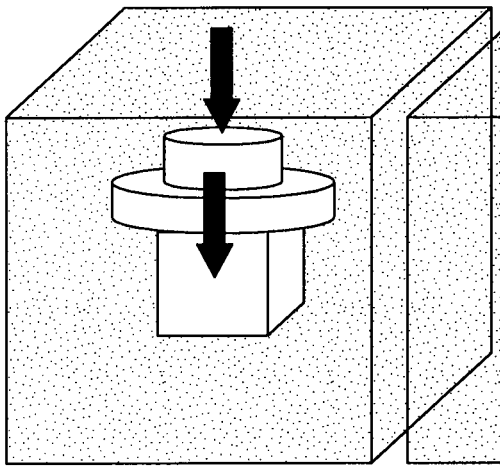
FIG. 19C PRIOR ART
Figure 19D:
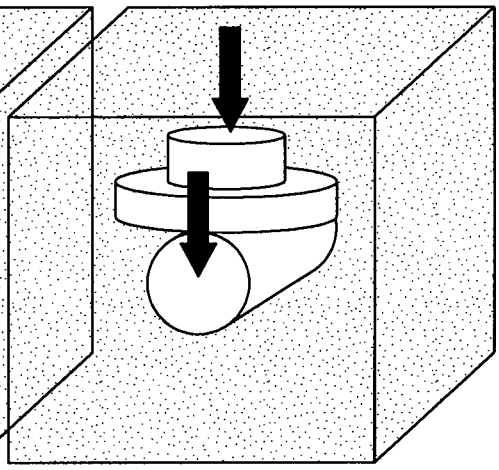
FIG. 19D PRIOR ART
Figures 20A, 20B:
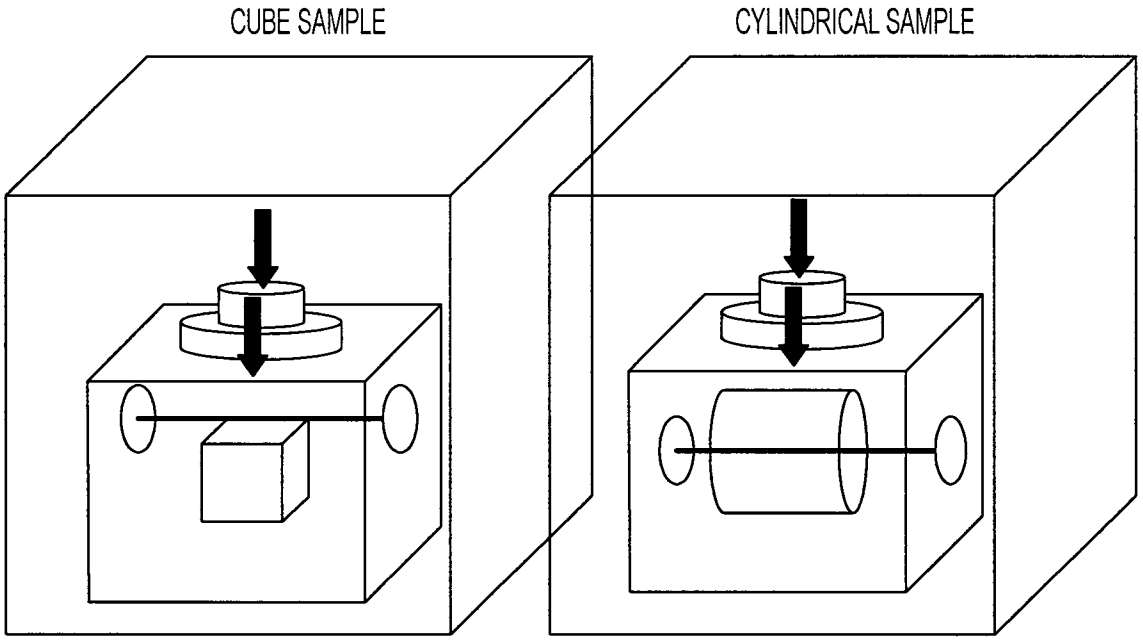
FIGS. 20A-B shows cryostats according to another embodiment of the present disclosure.

The items described in that previous filing achieve low vibration by detailing another innovation which dampens vibration to any sample mount. It has been shown that the combination of the two items offers better decoupling of vibrations to the sample than the GXB 100 by itself, or the low vibration module by itself. The combination provides low displacement of the GXB 100 while still providing good thermal transfer, and also may reduce some of the forces transferred from the cold finger to the GXB 100. It is anticipated that while the low vibration module may be used by itself, and the GXB 100 may be used by itself, the most benefit for mounting delicate objects will be provided by these items being used together as shown in FIG. 16.

The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the disclosure. However, it should be recognized that the present disclosure can be practiced without resorting to the details specifically set forth. In other instances, well known processing structures have not been described in detail, in order not to unnecessarily obscure the present disclosure.

Only a few examples of the present disclosure are shown and described herein. It is to be understood that the disclosure is capable of use in various other combinations and environments and is capable of changes or modifications within the scope of the inventive concepts as expressed herein.

The invention claimed is:

1. A sample mounting apparatus for a cryo-cooler comprising:

a housing having an outer wall surface for connecting to the cryo-cooler, and an inner wall surface; and a delicate mount attached to the inner wall surface of the housing for rotatably supporting the sample and substantially preventing vibrations from being transferred to the sample from the cryo-cooler, wherein the housing is sealable to contain an inert gas;

wherein the sample comprises a shaft, and the delicate mount comprises the shaft and a vibration reducing connector for rotatably connecting the shaft to the housing inner wall surface; and wherein the vibration reducing connector comprises a ball bearing assembly for rotatably mounting the shaft to the housing inner wall surface.

2. The sample mounting apparatus of claim 1, wherein the housing comprises a main body and a removable end plate, and the endplate is sealed to the main body with indium.

3. The sample mounting apparatus of claim 1, wherein the housing comprises a main body and a removable end plate, and the endplate is sealed to the main body with epoxy.

4. The sample mounting apparatus of claim 1, wherein the housing comprises a main body and a removable end plate, and the endplate is sealed to the main body with solder.

5. The sample mounting apparatus of claim 1, wherein the inert gas comprises helium.

6. The sample mounting apparatus of claim 1, wherein the inert gas comprises nitrogen.

7. A sample mounting apparatus for a cryo-cooler comprising:

a housing having an outer wall surface for connecting to the cryo-cooler, and an inner wall surface; and a delicate mount attached to the inner wall surface of the housing for rotatably supporting the sample and substantially preventing vibrations from being transferred to the sample from the cryo-cooler, wherein the housing is sealable to contain an inert gas;

wherein the delicate mount comprises a shaft attachable to the sample, and a vibration reducing connector for rotatably connecting the shaft to the housing inner wall surface; and wherein the vibration reducing connector comprises a ball bearing assembly for rotatably mounting the shaft to the housing inner wall surface.

8. A sample mounting apparatus for a cryo-cooler comprising:

a housing having an outer wall surface for connecting to the cryo-cooler, and an inner wall surface; and a delicate mount attached to the inner wall surface of the housing for rotatably supporting the sample and substantially preventing vibrations from being transferred to the sample from the cryo-cooler, wherein the housing is sealable to contain an inert gas;

wherein the delicate mount comprises a shaft attachable to the sample, and a vibration reducing connector for rotatably connecting the shaft to the housing inner wall surface; and wherein the vibration reducing connector comprises a sleeve attached to the housing inner wall surface and a ball bearing assembly attached to the sleeve and the shaft for rotatably mounting the shaft to the housing inner wall surface.

9. The sample mounting apparatus of claim 1, wherein the housing further comprises a transparent window portion for optical access to the sample.

10. The sample mounting apparatus of claim 9, wherein the window portion is sealed to the housing with an indium seal.

11. The sample mounting apparatus of claim 9, wherein window portion is attached to the housing with epoxy or glue, and the housing contains a housekeeper seal to accommodate the differences in size of materials due to thermal expansion.

12. The sample mounting apparatus of claim 8, wherein said sleeve and bearing assembly are attached to the housing inner wall via epoxy.

13. The sample mounting apparatus of claim 8, wherein said sleeve and bearing assembly are attached to the housing inner wall via solder or mechanical attachments.

14. The sample mounting apparatus of claim 1, wherein said housing is comprised of copper.

15. The sample mounting apparatus of claim 1, wherein the housing further comprises a recess in the external housing for inserting at least one magnet such that a variable homogeneous or inhomogeneous magnetic field is applied to the sample.

* * * * *